US006570548B2

(12) United States Patent
Smith

(10) Patent No.: US 6,570,548 B2
(45) Date of Patent: May 27, 2003

(54) DISPLAY DEVICE FOR PROVIDING GRAPHICAL DISPLAY HAVING A VARIABLE NUMBER OF VERTICAL AND HORIZONTAL LINES OF RESOLUTION

(76) Inventor: Ronald E. Smith, 120 Little East Neck Rd., Babylon, NY (US) 11702

( * ) Notice: Subject to any disclaimer, the term of this patent is extended or adjusted under 35 U.S.C. 154(b) by 179 days.

(21) Appl. No.: 09/688,915

(22) Filed: Feb. 6, 2001

(65) Prior Publication Data

US 2003/0016197 A1 Jan. 23, 2003

(51) Int. Cl.[7] ..... G09G 3/32

(52) U.S. Cl. ..... 345/83; 345/44; 345/45; 345/46; 345/55; 345/76; 345/82; 345/205; 345/206

(58) Field of Search ..... 345/55, 44–46, 345/76, 83, 82, 205–206; 362/231, 249; 257/87–90, 101–103

(56) References Cited

U.S. PATENT DOCUMENTS

| | | | | | |
|---|---|---|---|---|---|
| 5,198,803 | A | * | 3/1993 | Shie et al. | 340/815.45 |
| 5,313,729 | A | | 5/1994 | Sakai et al. | 40/452 |
| 5,400,228 | A | * | 3/1995 | Kao | 362/231 |
| 5,444,456 | A | | 8/1995 | Ohta et al. | 345/39 |
| 5,577,832 | A | | 11/1996 | Lodhie | 362/249 |
| 5,657,159 | A | | 8/1997 | Natori | 359/448 |
| 5,722,767 | A | | 3/1998 | Lin | 362/249 |
| 5,751,263 | A | * | 5/1998 | Huang et al. | 33/2 R |
| 5,812,105 | A | * | 9/1998 | Van de Ven | 345/46 |
| 5,818,404 | A | * | 10/1998 | Lebby et al. | 257/81 |
| 5,835,269 | A | | 11/1998 | Natori | 359/448 |
| 5,952,680 | A | * | 9/1999 | Strite | 144/162.1 |
| 6,008,784 | A | * | 12/1999 | Acres et al. | 345/55 |
| 6,065,854 | A | * | 5/2000 | West et al. | 211/87.01 |
| 6,333,603 | B1 | * | 12/2001 | Juang et al. | 313/496 |
| 6,347,880 | B1 | * | 2/2002 | Furst et al. | 362/494 |
| 6,348,905 | B1 | * | 2/2002 | Wang | 315/169.3 |

* cited by examiner

*Primary Examiner*—Bipin Shalwala
*Assistant Examiner*—Leonid Shapiro
(74) *Attorney, Agent, or Firm*—Richard L. Miller

(57) ABSTRACT

A display device that includes video chips. Each video chip is modular and is engageable with adjacent video chips, a plurality of pins that electrically communicate with the set of pins of adjacent video chips, and pixels that electrically communicate with the plurality of pins thereof. Each pixel is engageable with adjacent pixels, a red LED for selective illumination, a green LED for selective illumination, and a blue LED for selective illumination. The video chips are placed in an array of columns and rows which are activated by vertical scanning and horizontal scanning. The rows are supplied with a positive voltage to prevent conduction. The vertical scanning activates each row by reducing back voltage to zero. The horizontal scanning activates each column at three different levels for activating at least one of the red LED, the green LED, and the blue LED.

13 Claims, 2 Drawing Sheets

DISPLAY DEVICE FOR PROVIDING GRAPHICAL DISPLAY HAVING A VARIABLE NUMBER OF VERTICAL AND HORIZONTAL LINES OF RESOLUTION

BACKGROUND OF THE INVENTION

1. Field of the Invention

The present invention relates to a display device. More particularly, the present invention relates to a display device for providing a graphical-type display having a variable number of vertical and horizontal lines of resolution.

2. Description of the Prior Art

Numerous innovations for LED displays have been provided in the prior art that will be described. Even though these innovations may be suitable for the specific individual purposes to which they address, however, they differ from the present invention.

A FIRST EXAMPLE, U.S. Pat. No. 5,313,729 to Sakai et al. teaches an LED display unit that comprises a printed circuit board. A plurality of LEDs are packaged on the printed circuit board. Portions of the respective LEDs except for light emitting sections thereof are sealed by a resin. The LEDs having the portions thereof sealed by the resin are received in a case. A plurality of the cases are arranged on the attaching plate, to form a large-sized display panel. The case has a rear face thereof which is brought to a configuration in which spaces exist between the attaching plate and portions of the case except for a fixing portion thereof to the attaching plate and a connector for wiring.

A SECOND EXAMPLE, U.S. Pat. No. 5,400,228 to Kao teaches a full-color illuminating unit that includes a first circuit board which is a disk having a hole and a plurality of green lights and red lights installed around the hole. A second circuit board which is a disk includes a blue light installed thereon. A first housing has an isolation plate integrally connected with an inner periphery thereof, thus separating the first housing into a first cavity and a second cavity. The first circuit board is installed in the first cavity while the second circuit board is installed in the second cavity. A boss protrudes from the isolation plate to the first cavity and is in communication between the first cavity and the second cavity. The first circuit board is positioned in place, with the periphery of the hole thereof being around the boss. The blue light is positioned in the boss, with a portion thereof protruding beyond an opening of the boss. A second housing is attached to the first housing, thus enclosing the second circuit board.

A THIRD EXAMPLE, U.S. Pat. No. 5,444,456 to Ohta et al. teaches a display apparatus that is held and swung by an operator to display images of pictures, letters, etc. in space using an afterimage effect, a party situated opposite to the operator is enabled to recognize the images displayed always at the central position of the swing range and with the same dimensions irrespective of the swinging speed and to see the same images displayed even of an asymmetrical pattern irrespective of the directions of the swing of the apparatus. The display apparatus has a transparent protective case covering both side faces, right and left, of an array of LEDs, a measuring unit to measure the cycle time of right and left reciprocating motion, a computing unit to process by computation the measured cycle time, a memory unit to memorize the processed results and a timer circuit unit to control turning the LEDs on and off. This set-up enables a party situated opposite to the operator of the display apparatus to see correct images of letters and pictures displayed always at the center of the swinging width range regardless of the swinging speed.

A FOURTH EXAMPLE, U.S. Pat. No. 5,577,832 to Lodhie teaches a multi-layer LED assembly which is used as a replacement light for equipment used in manufacturing environments. On each layer of the multi-layer assembly, there are multiple LEDs which are mounted perpendicular to a base. The base is used to provide electrical and mechanical connection to a socket. The LED assembly is constructed in a manner which allows the LED assembly to be inserted into a socket of a lighting fixture and then mechanical and electrical connections ar provided without requiring rotation of the LED assembly. Electrical connection is by permanently attached wires between the base and the LEDs. The base is rotatable within a predetermined angular range which is sufficient to provide a proper mechanical and electrical connection without putting strain on the permanently attached electrical wires. The LED assembly may utilize multiple layers of LEDs, with each layer itself having multiple LEDs. The LEDs in each layer are mounted in a direction perpendicular to the base which results in light emanating in a direction perpendicular to the base.

A FIFTH EXAMPLE, U.S. Pat. No. 5,657,159 to Natori teaches a video display apparatus that has a dot matrix of LEDs mounted on an LED matrix board, and a unitary reflecting member made of metal such as aluminum or the like mounted on the LED matrix board. The reflecting member has slanted reflecting surfaces disposed vertically one on each side of each of the LEDs for reflecting light emitted from the LEDs with narrow vertical directivity. The video display apparatus can provide a wide angle of view in the horizontal direction, and a narrow angle of view in the vertical direction for preventing light from being scattered in the vertical direction to maintain a desired level of luminosity.

A SIXTH EXAMPLE, U.S. Pat. No. 5,722,767 to Lin teaches an LED display panel structure that comprises a PC board, a front plate having a plurality of through-holes defined thereon, a plurality of washers, each of which is provided on a back surface of the front plate in correspondence with each of the through-holes, a plurality of LEDs, each of which is inserted through a central aperture of each of the washers being smaller than a diameter of the LED to be clamped therein, and a plurality of holders, each of which has a first recess and a second recess, each of the holders receives and holds each of the LEDs in its first recess and is attached on the PC board by water resistant adhesive filled in the second recess. A pair of through-bores communicating the first recess with the second recess are defined therebetween to allow a pair of leads of each of the LEDs to extend therethrough and connect to the PC board. Such a structure can prevent moisture from seeping in to damage the LEDs.

A SEVENTH EXAMPLE, U.S. Pat. No. 5,835,269 to Natori teaches a video display apparatus that has a dot matrix of LEDs mounted on an LED matrix board, and a unitary reflecting member made of metal such as aluminum or the like mounted on the LED matrix board. The reflecting member has slanted reflecting surfaces disposed vertically one on each side of each of the LEDs for reflecting light emitted from the LEDs with narrow vertical directivity. The video display apparatus can provide a wide angle of view in the horizontal direction, and a narrow angle of view in the vertical direction for preventing light from being scattered in the vertical direction to maintain a desired level of luminosity.

AN EIGHTH EXAMPLE, U.S. Pat. No. 5,952,680 to Strite teaches an array of light emitting diodes (LEDs) for the generation of light at multiple wavelengths. The LEDs are realized in a layered structure of semiconductor films grown on one substrate, said array comprising conducting portions for applying a bias to said LEDs and insulating portions, wherein at least one of the insulating or conducting portions is formed by a lateral variation of doping conditions of the top layer of the structure.

It is apparent that numerous innovations for LED displays have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a display device for providing a graphical-type display having a variable number of vertical and horizontal lines of resolution that avoids the disadvantages of the prior art.

ANOTHER OBJECT of the present invention is to provide a display device for providing a graphical-type display having a variable number of vertical and horizontal lines of resolution that is simple and inexpensive to manufacture.

STILL ANOTHER OBJECT of the present invention is to provide a display device for providing a graphical-type display having a variable number of vertical and horizontal lines of resolution that is simple to use.

BRIEFLY STATED, YET ANOTHER OBJECT of the present invention is to provide a display device that includes video chips. Each video chip is modular for providing different sizes for the video display and includes a chip substrate that is engageable with the chip substrate of adjacent video chips, respectively, so as to form a matrix of chip substrates without any gaps therebetween by virtue of close edge tolerances so as to provide a full screen display device with no discernable edge effects, a plurality of pins that electrically communicate with the set of pins of adjacent video chips, respectively, so as to allow all the video chips to continue in sequence, both vertically and horizontally, and pixels that electrically communicate with the plurality of pins thereof. Each pixel includes a pixel substrate that is engageable with the pixel substrate of adjacent pixels, respectively, so as to form a matrix of pixel substrates, a red LED for selective illumination, a green LED for selective illumination, and a blue LED for selective illumination. The video chips are placed in an array of columns and rows which are activated by vertical scanning and horizontal scanning. The rows are supplied with a positive voltage to prevent conduction. The vertical scanning activates each row by reducing back voltage to zero. The horizontal scanning activates each column at three different levels for activating at least one of the red LED, the green LED, and the blue LED.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 4:
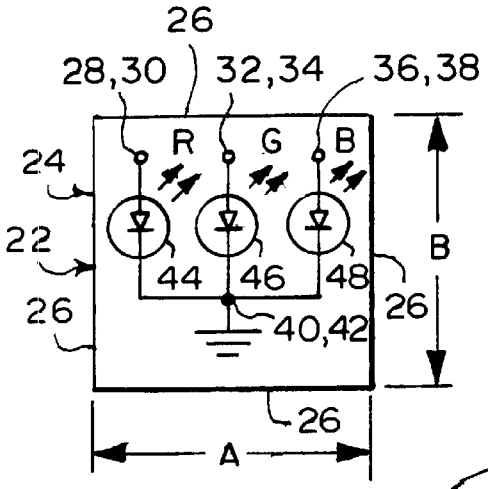
FIG. 4 is a schematic view of the area generally enclosed by the dotted curve identified by arrow 4 in FIG. 2 of one pixel of the present invention.

10 display device of present invention for providing a graphical-type display having variable number of vertical and horizontal lines of resolution
12 printed circuit board for mounting on surface 13
13 surface
14 video chips for selective illumination
16 substrate of each video chip of video chips 14
18 four edges of substrate 16 of each video chip of video chips 14
20 plurality of pins of each video chip of video chips 14
22 pixels of each video chip of video chips 14
24 pixel substrate of each pixel of pixels 22 of each video chip of video chips 14
26 four edges of pixel substrate 24 of each pixel of pixels 22 of each video chip of video chips 14
28 first contact of each pixel of pixels 22 of each video chip of video chips 14
30 first individual pin of plurality of pins 20 of respective video chip of video chips 14
32 second contact of each pixel of pixels 22 of each video chip of video chips 14
34 second individual pin of plurality of pins 20 of respective video chip of video chips 14
36 third contact of each pixel of pixels 22 of each video chip of video chips 14
38 third individual pin of plurality of pins 20 of respective video chip of video chips 14
40 fourth contact of each pixel of pixels 22 of each video chip of video chips 14
42 fourth individual pin of plurality of pins 20 of respective video chip of video chips 14 for going to ground
44 red LED of each pixel of pixels 22 of each video chip of video chips 14 for selective illumination, and when illuminated, imparts red color to respective pixel of pixels 22 of each video chip of video chips 14
46 green LED of each pixel of pixels 22 of each video chip of video chips 14 for selective illumination, and when illuminated, imparts green color to respective pixel of pixels 22 of each video chip of video chips 14
48 blue LED of each pixel of pixels 22 of each video chip of video chips 14 for selective illumination, and when illuminated, imparts blue color to respective pixel of pixels 22 of each video chip of video chips 14
50 square waves for driving vertical scanning and horizontal scanning for activating array of columns and rows of video chips 14

DETAILED DESCRIPTION OF THE PREFERRED EMBODIMENT

Figure 1:
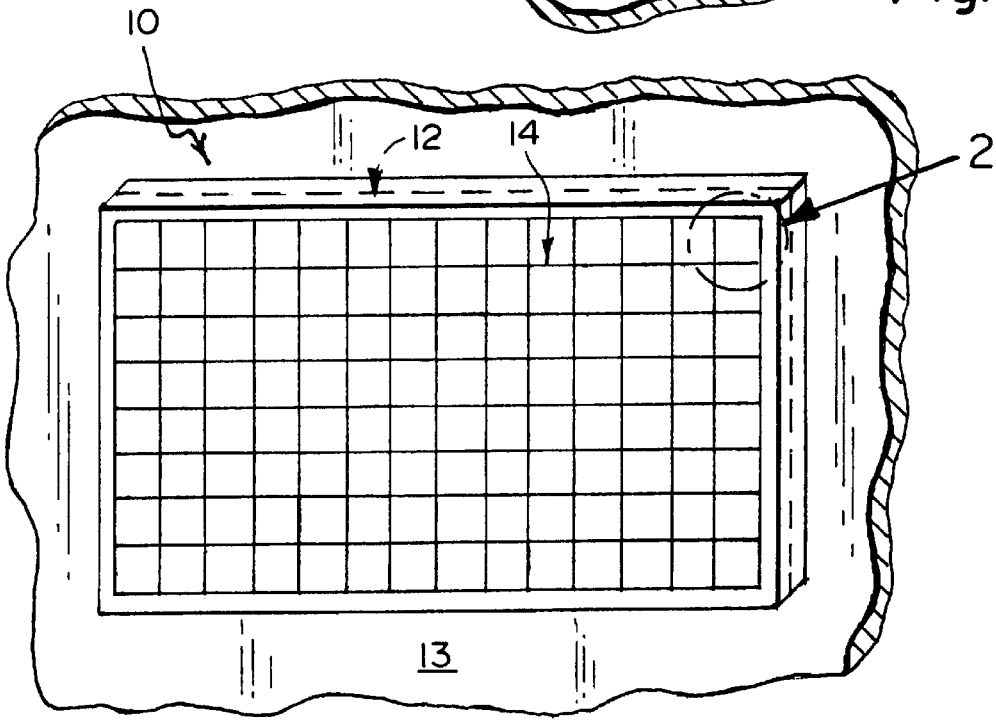
FIG. 1 is a diagrammatic perspective view of the present invention.

Referring now to the figures, in which like numerals indicate like parts, and particularly to FIG. 1, the display device of the present invention is shown generally at 10 for providing a graphical-type display having a variable number of vertical and horizontal lines of resolution.

The overall configuration of the display 10 can best be seen in FIG. 1, and as such, will be discussed with reference thereto.

The display device 10 comprises a printed circuit board 12 for mounting on a surface 13 and video chips 14 disposed on, and electrically communicating with, the printed circuit board 12 for selective illumination.

The printed circuit board 12 is flat for using the video display 10 as a flat TV screen.

The printed circuit board 12 is dome-shaped for using the video display 10 for a simulator.

Figure 2:
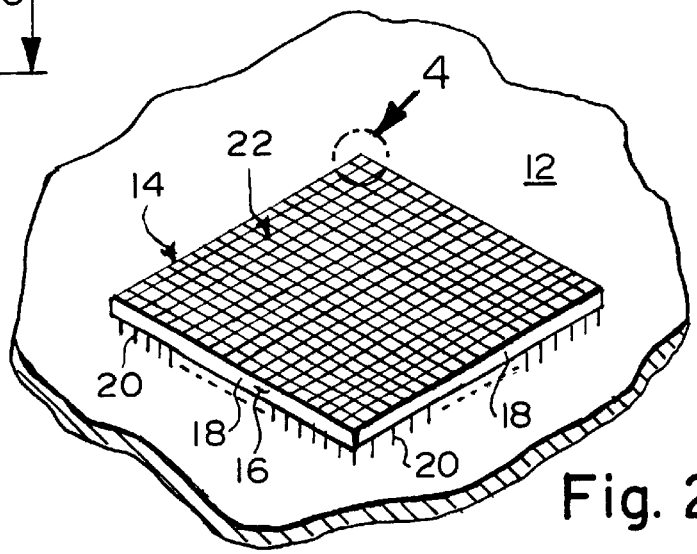
FIG. 2 is a diagrammatic perspective view of the area generally enclosed by the dotted curve identified by arrow 2 in FIG. 1 of one video chip of the present invention.
Figure 3:
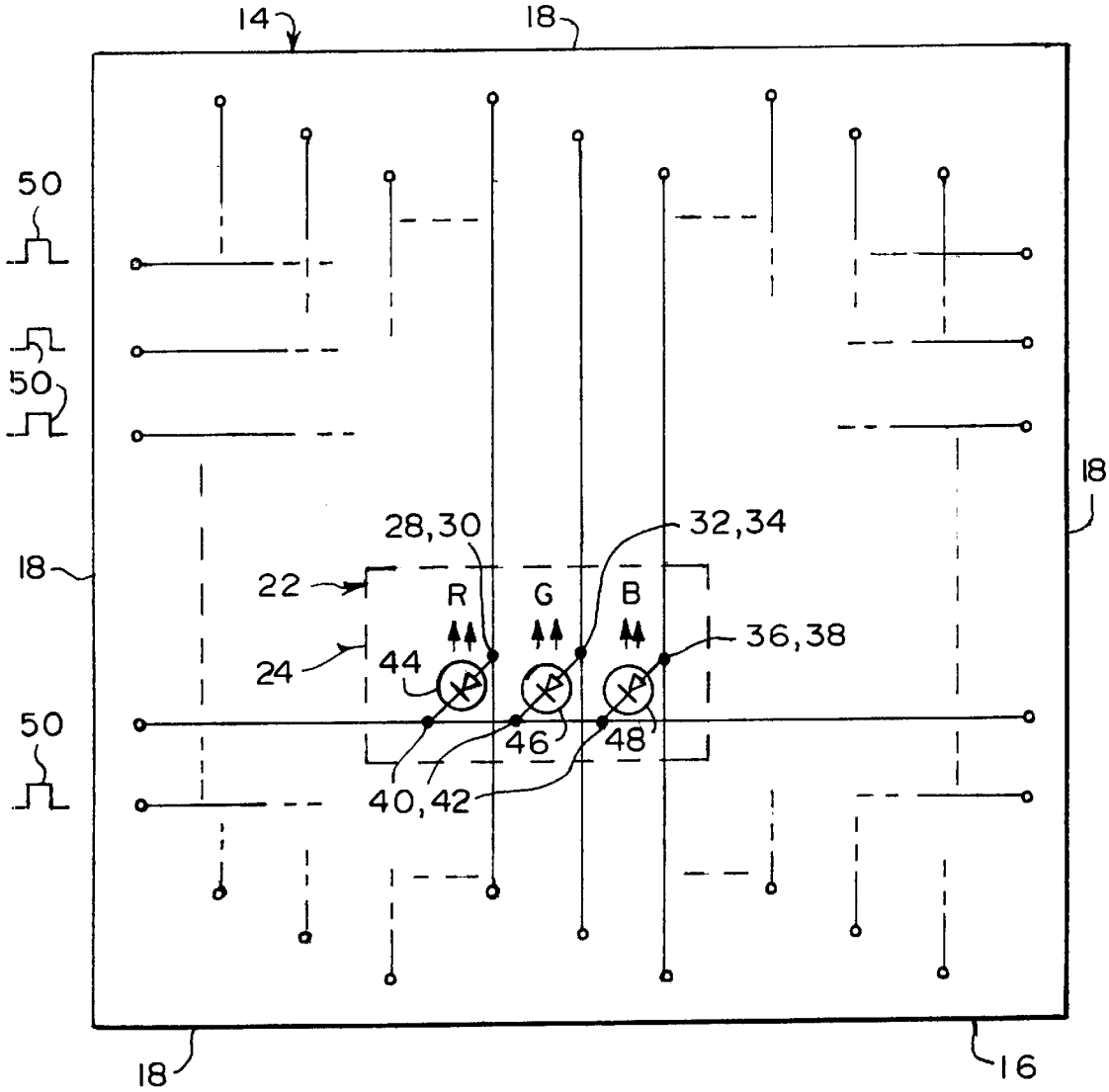
FIG. 3 is a schematic view of the of one video chip of the present invention shown in FIG. 2.

The specific configuration of each of the video chips 14 can best be seen in FIGS. 2 and 3, and as such, will be discussed with reference thereto.

The video chips 14 are placed in an array that electrically communicate with each other.

Each video chip 14 is modular for providing different sizes for the video display 10, depending upon application, by virtue of electrically communicating different amounts of the video chips 14 with each other.

Each video chip 14 comprises a chip substrate 16 that is square-shaped, and as a result thereof, has four edges 18 that are coincidable with the four edges 18 of the chip substrate 16 of adjacent video chips 14, respectively, so as to form a matrix of chip substrates 16 that have a predetermined number of rows and columns without any gaps therebetween by virtue of close edge tolerances so as to provide a full screen display device with no discernable edge effects.

The chip substrate 16 is a simple glass substrate not requiring an active matrix, as is required by liquid crystal displays, by virtue of high response time of the simple glass substrate.

Each video chip 14 further comprises a plurality of pins 20 that depend from the chip substrate 16 thereof and electrically communicate with the printed circuit board 12 and the set of pins 20 of adjacent video chips 14, respectively, so as to allow all the video chips 14 to continue in sequence, both vertically and horizontally.

The plurality of pins 20 are formed into a matrix that has a predetermined number of rows and columns.

Each video chip 14 further comprises pixels 22 that are disposed on the chip substrate 16 thereof and electrically communicate with the plurality of pins 20 thereof.

The specific configuration of each of the pixels 22 can best be seen in FIGS. 3 and 4, and as such, will be discussed with reference thereto.

Each pixel 22 comprises a pixel substrate 24 that is square-shaped, and as a result thereof, has four edges 26 that are coincidable with the four edges 26 of the pixel substrate 24 of adjacent pixels 22, respectively, so as to form a matrix of pixel substrates 24 that have a predetermined number of rows and columns.

Each pixel 22 further comprises a first contact 28 that is disposed on the pixel substrate 24 thereof and electrically communicates with a first individual pin 30 of the plurality of pins 20 of a respective video chip 14.

The first contact 28 of each pixel 22 electrically communicates with a different first individual pin 30 of the plurality of pins 20 of the respective video chip 14.

Each pixel 22 further comprises a second contact 32 that is disposed on the pixel substrate 24 thereof, is electrically independent from the first contact 28 thereof, and electrically communicates with a second individual pin 34 of the plurality of pins 20 of the respective video chip 14.

The second contact 32 of each pixel 22 electrically communicates with a different second individual pin 34 of the plurality of pins 20 of the respective video chip 14.

Each pixel 22 further comprises a third contact 36 that is disposed on the pixel substrate 24 thereof, is electrically independent from the first contact 28 thereof and the second contact 32 thereof, and electrically communicates with a third individual pin 38 of the plurality of pins 20 of the respective video chip 14.

The third contact 36 of each pixel 22 electrically communicates with a different third individual pin 38 of the plurality of pins 20 of the respective video chip 14.

Each pixel 22 further comprises a fourth contact 40 that is disposed on the pixel substrate 24 thereof, is electrically independent from the first contact 28 thereof, the second contact 32 thereof, and the third contact 36 thereof, and electrically communicates with a fourth individual pin 42 of the plurality of pins 20 of the respective video chip 14 for going to ground.

The fourth contact 40 of each pixel 22 electrically communicates with a different fourth individual pin 42 of the plurality of pins 20 of the respective video chip 14.

Each pixel 22 further comprises a red LED 44 that is disposed on the pixel substrate 24 thereof and electrically communicates across the first contact 28 thereof and the fourth contact 40 thereof for selective illumination, and when illuminated, imparts a red color to the pixel 22.

The red LED 44 is assembled onto the pixel substrate 24 by vapor deposition.

The red LED 44 is gallium arsenide.

Each pixel 22 further comprises a green LED 46 that is disposed on the pixel substrate 24 thereof and electrically communicates across the second contact 32 thereof and the fourth contact 40 thereof for selective illumination, and when illuminated, imparts a green color to the pixel 22.

The green LED 46 is assembled onto the pixel substrate 24 by vapor deposition.

The green LED 46 is gallium phosphide.

Each pixel 22 further comprises a blue LED 48 that is disposed on the pixel substrate 24 thereof and electrically communicates across the third contact 36 thereof and the fourth contact 40 thereof for selective illumination, and when illuminates, imparts a blue color to the pixel 22.

The blue LED 48 is assembled onto the pixel substrate 24 by vapor deposition.

The blue LED 48 is gallium nitride.

The video chips 14 are placed in an array of columns and rows, which are activated by vertical scanning and horizontal scanning for driving by square waves 50, and which are of a number dependent upon desired resolution.

The rows of the array of the video chips 14 are supplied with a positive voltage to prevent conduction, by virtue of the red LED 44, the green LED 46, and the blue LED 48, by definition, being diodes, which by definition, allow conduction in only one direction.

The vertical scanning actives each row of the array of the video chips 14 by reducing back voltage to zero.

The horizontal scanning activates each column of the array of the video chips 14 at three different levels for activating at least one of the red LED 44, the green LED 46, and the blue LED 48.

It will be understood that each of the elements described above, or two or more together, may also find a useful application in other types of constructions differing from the types described above.

While the invention has been illustrated and described as embodied in a display device for providing a graphical-type display having a variable number of vertical and horizontal lines of resolution, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A display device for providing a graphical-type display having a variable number of vertical and horizontal lines of resolution, said device comprising:

a) a printed circuit board for mounting on a surface; and b) video chips disposed on, and electrically communicating with, said printed circuit board for selective illumination;

wherein each video chip comprises a chip substrate that is square-shaped, and as a result thereof, has four edges that are coincidable with said four edges of said chip substrate of adjacent video chips, respectively, so as to form a matrix of chip substrates that have a predetermined number of rows and columns without any gaps therebetween by virtue of close edge tolerances so as to provide a full screen display device with no discernable edge effects;

wherein each video chip further comprises a plurality of pins that depend from said chip substrate thereof and electrically communicate with said printed circuit board and said set of pins of adjacent video chips, respectively, so as to allow all said video chips to continue in sequence, both vertically and horizontally;

wherein each video chip further comprises pixels that are disposed on said chip substrate thereof and electrically communicate with said plurality of pins thereof;

wherein each pixel comprises a pixel substrate that is square-shaped, and as a result thereof, has four edges that are coincidable with said four edges of said pixel substrate of adjacent pixels, respectively, so as to form a matrix of pixel substrates that have a predetermined number of rows and columns;

wherein each pixel further comprises a first contact that is disposed on said pixel substrate thereof and electrically communicates with a first individual pin of said plurality of pins of a respective video chip;

wherein said first contact of each pixel electrically communicates with a different first individual pin of said plurality of pins of said respective video chip;

wherein each pixel further comprises a second contact that is disposed on said pixel substrate thereof, is electrically independent from said first contact thereof, and electrically communicates with a second individual pin of said plurality of pins of said respective video chip;

wherein said second contact of each pixel electrically communicates with a different second individual pin of said plurality of pins of a respective video chip;

wherein each pixel further comprises a third contact that is disposed on said pixel substrate thereof, is electrically independent from said first contact thereof and said second contact thereof, and electrically communicates with a third individual pin of said plurality of pins of said respective video chip;

wherein said third contact of each pixel electrically communicates with a different third individual pin of said plurality of pins of a respective video chip;

wherein each pixel further comprises a fourth contact that is disposed on said pixel substrate thereof, is electrically independent from said first contact thereof, said second contact thereof, and said third contact thereof, and electrically communicates with a fourth individual pin of said plurality of pins of said respective video chip for going to ground;

wherein said fourth contact of each pixel electrically communicates with a different fourth individual pin of said plurality of pins of a respective video chip;

wherein each pixel further comprises a red LED that is disposed on said pixel substrate thereof and electrically communicates across said first contact thereof and said fourth contact thereof for selective illumination, and when illuminated, imparts a red color to said pixel;

wherein each pixel further comprises a green LED that is disposed on said pixel substrate thereof and electrically communicates across said second contact thereof and said fourth contact thereof for selective illumination, and when illuminated, imparts a green color to said pixel;

wherein each pixel further comprises a blue LED that is disposed on said pixel substrate thereof and electrically communicates across said third contact thereof and said fourth contact thereof for selective illumination, and when illuminates, imparts a blue color to said pixel;

wherein said video chips are placed in an array of columns and rows, which are activated by vertical scanning and horizontal scanning for driving by square waves, and which are of a number dependant upon desired resolution;

wherein said rows of said array of said video chips are supplied with a positive voltage to prevent conduction, by virtue of said red LED, said green LED, and said blue LED, by definition, being diodes, which by definition, allow conduction in only one direction;

wherein said vertical scanning actives each row of said array of said video chips by reducing back voltage to zero; and wherein said horizontal scanning activates each column of said array of said video chips at three different levels for activating at least one of said red LED, said green LED, and said blue LED.

2. The device as defined in claim 1, wherein said printed circuit board is flat for using said video display as a flat TV screen.

3. The device as defined in claim 1, wherein said printed circuit board is dome-shaped for using said video display for a simulator.

4. The device as defined in claim 1, wherein said video chips are placed in an array that electrically communicate with each other.

5. The device as defined in claim 1, wherein each video chip is modular for providing different sizes for said video display, depending upon application, by virtue of electrically communicating different amounts of said video chips with each other.

6. The device as defined in claim 1, wherein said chip substrate is a glass.

7. The device as defined in claim 1, wherein said plurality of pins are formed into a matrix that has a predetermined number of rows and columns.

8. The device as defined in claim 1, wherein said red LED is assembled onto said pixel substrate by vapor deposition.

9. The device as defined in claim 1, wherein said red LED is gallium arsenide.

10. The device as defined in claim 1, wherein said green LED is assembled onto said pixel substrate by vapor deposition.

11. The device as defined in claim 1, wherein said green LED is gallium phosphide.

12. The device as defined in claim 1, wherein said blue LED is assembled onto said pixel substrate by vapor deposition.

13. The device as defined in claim 1, wherein said blue LED is gallium nitride.

* * * * *